US012071778B2

(12) United States Patent
French

(10) Patent No.: US 12,071,778 B2
(45) Date of Patent: Aug. 27, 2024

(54) WALL REPAIR DEVICE

(71) Applicant: Arron French, Townsville (AU)

(72) Inventor: Arron French, Townsville (AU)

( * ) Notice: Subject to any disclaimer, the term of this patent is extended or adjusted under 35 U.S.C. 154(b) by 204 days.

(21) Appl. No.: 17/624,343

(22) PCT Filed: Jul. 2, 2020

(86) PCT No.: PCT/AU2020/050693
§ 371 (c)(1),
(2) Date: Jan. 1, 2022

(87) PCT Pub. No.: WO2021/000019
PCT Pub. Date: Jan. 7, 2021

(65) Prior Publication Data

US 2022/0275659 A1 Sep. 1, 2022

(30) Foreign Application Priority Data

Jul. 3, 2019 (AU) ..... 2019902360

(51) Int. Cl.
*E04G 23/02* (2006.01)

(52) U.S. Cl.
CPC ..... *E04G 23/0207* (2013.01)

(58) Field of Classification Search
CPC ..... E04G 23/0207; E04G 23/0203; E04G 23/0214; Y10T 428/20; Y10T 29/49732
See application file for complete search history.

(56) References Cited

U.S. PATENT DOCUMENTS 3,325,955 A * 6/1967 Haut ..... E04F 21/02 52/514
3,690,084 A * 9/1972 Leblanc ..... E04G 23/0207 52/514
3,834,107 A * 9/1974 Standing ..... E04G 23/0207 52/514
4,075,809 A * 2/1978 Sirkin ..... E04G 23/0207 52/514
4,193,243 A * 3/1980 Tiner ..... E04G 23/0207 52/514
4,848,056 A * 7/1989 Kelly ..... E04G 23/0207 52/514
5,048,796 A * 9/1991 Maldonado ..... E04G 23/0203 254/133 A (Continued)

FOREIGN PATENT DOCUMENTS

EP 3489436 A1 5/2019
GB 2463874 A * 3/2010 ..... E04G 23/0203

(Continued)

*Primary Examiner* — Theodore V Adamos
(74) *Attorney, Agent, or Firm* — Jeanette M. Braun; Braun IP Law, LLC

(57) ABSTRACT

A device for repairing a hole in a wall structure, the device comprising: a body; a plurality of arm members mounted relative to the body, wherein a webbing member extends between two or more of the arm members; and a displaceable member associated with the body, wherein displacement of the displaceable member actuates the plurality of arm members to move relative to the body between a retracted condition and an extended condition in which the webbing member is stretched relatively tightly between the arm members to form a substantially planar surface.

13 Claims, 5 Drawing Sheets

(56) References Cited

U.S. PATENT DOCUMENTS

| | | | | | |
|---|---|---|---|---|---|
| 5,983,587 | A * | 11/1999 | Limonad | E04G 23/0207 | 52/514 |
| 6,044,613 | A * | 4/2000 | Crafts | E04G 23/0203 | 29/402.09 |
| 6,317,952 | B1 * | 11/2001 | Vogt | E04G 23/0203 | 52/27 |
| 2002/0083679 | A1 * | 7/2002 | Hanner | E04G 23/0207 | 52/514 |
| 2005/0204672 | A1 * | 9/2005 | Hansen | B63B 43/16 | 52/514 |
| 2008/0083185 | A1 * | 4/2008 | Lin | E04G 23/0203 | 52/514 |
| 2013/0312362 | A1 * | 11/2013 | Maanum | E04G 21/02 | 251/212 |
| 2016/0208506 | A1 | 7/2016 | Butler | | |

FOREIGN PATENT DOCUMENTS

| | | | | |
|---|---|---|---|---|
| JP | 2009197840 | A | 9/2009 | |
| WO | WO-2012079119 | A1 * | 6/2012 | E04G 23/0207 |

* cited by examiner

WALL REPAIR DEVICE

CROSS-REFERENCE TO RELATED APPLICATIONS

This application claims priority benefit from PCT/AU2020/050693 filed Jul. 2, 2020, currently pending, which claims priority to Australia Ser. No. 2019902360 filed Jul. 3, 2019, each being incorporated by reference in its entirety as if fully restated herein.

TECHNICAL FIELD

The present invention relates to a wall repair device and method. In particular, the invention relates to, but is not limited to a device and a method for repairing a hole in a wall structure.

BACKGROUND ART

Plasterboard or drywall panels are commonly used construction materials for lining walls and ceilings. In typical wall structures, plasterboard panels are secured to timber or steel frames forming a cavity between opposing wall members to accommodate insulation material, electrical conduits, cables and pipes. Although plasterboard panels are quick and easy to install, they are vulnerable to impact damage, such as dents and holes.

For small dents and holes, many homeowners would attempt to repair or conceal the damage by placing an adhesive mesh patch onto the wall surface and applying a poly or spackle filler over the patch. However, often the repaired surface may not be flush with the wall surface, or the homeowner may apply insufficient filler so that the mesh patch may be visible through the filler.

Alternatively, some mesh patches can be adhered on the inside of the damaged wall structure allowing the homeowner to fill the hole with a poly or spackle filler until it is flush with the wall surface. While this approach may overcome the problems associated with placing an adhesive patch on the exposed wall surface, it is difficult to securely adhere the patch on the inside of the wall structure having opposing panels and there is a chance that the patch and filler will fall off the wall into the wall cavity.

Whilst various patch solutions are available, many of these are difficult to implement when the inner surface of the wall member is not easily accessible. Additionally, patch solutions often conceal rather than repair the damage and the repairs may not be permanent or structurally sound.

Thus, there would be an advantage if it were possible to provide a device for repairing a hole in a wall that was also effective when working with wall structures having a cavity therein.

It will be clearly understood that, if a prior art publication is referred to herein, this reference does not constitute an admission that the publication forms part of the common general knowledge in the art in Australia or in any other country.

SUMMARY OF INVENTION

The present invention is directed to a device and a method for repairing a hole in a wall structure, which may at least partially overcome at least one of the abovementioned disadvantages or provide the consumer with a useful or commercial choice.

With the foregoing in view, the present invention in one form, resides broadly in a device for repairing a hole in a wall structure, the device comprising:

a body;

a plurality of arm members mounted relative to the body, wherein a webbing member extends between two or more of the arm members; and a displaceable member associated with the body;

wherein displacement of the displaceable member actuates the plurality of arm members to move relative to the body between a retracted condition and an extended condition in which the webbing member is stretched relatively tightly between the arm members to form a substantially planar surface.

The device may be of any suitable size, shape, or configuration. Preferably, however, the device is of sufficient size and shape to fit within the wall structure. Preferably, the device is also of sufficient size to fit within a cavity defined by opposing wall members. In an embodiment, the length of the device is less than the horizontal distance between the opposing wall members such that only one end of the device may be retained in abutment with, or close proximity to, the inner surface of one of the opposing wall members. In a preferred embodiment, the length of the device is substantially identical to the horizontal distance between the opposing wall members such that a first end of the device may be retained in abutment with, or close proximity to, an inner surface of a first wall member, while a second end of the device may be retained in abutment with, or close proximity to, an inner surface of an opposed second wall member. However, it will be understood that the diameter and shape of the device may vary depending on a number of factors, including the type of wall system. For instance, for an interior wall system with a relatively thin plasterboard, a smaller diameter device may be suitable.

The body may be of any suitable size, shape, or configuration. In an embodiment, the length of the body is substantially identical to the length of the device. The body may have any shape along its length. For instance, the body may be curved or may have two or more body portions disposed at angles to one another. In a preferred embodiment of the invention, the body may be substantially linear.

The body may be fabricated from any suitable material. For instance, the body may be fabricated from ferrous metals (such as mild steel, carbon steel, or the like), non-ferrous metals and alloys (such as aluminium, brass, or the like), polymeric materials, or plastic, and in particular, a relatively durable plastic such as polycarbonate, polyethylene, polypropylene, polystyrene, polyvinyl chloride, acrylonitrile butadiene styrene and the like, or any suitable combination thereof.

Alternatively, the body may be fabricated at least partially from a semi-rigid polymeric or plastic material such as, but not limited to, polycarbonate, polyethylene, polypropylene, polystyrene, polyvinyl chloride, acrylonitrile butadiene styrene and the like. For instance, the body may be fabricated solely from a semi-rigid material, or the body may be fabricated substantially from a semi-rigid material, but is attached to an end portion comprising a rigid material upon which the plurality of arms are mounted, or the body may comprise portions of rigid material extending longitudinally the length of the body and interspaced with semi-rigid material, or combinations thereof. It is envisaged that in use, a body of a device comprising a semi-rigid material may collapse upon application of force while the inclusion of sufficient rigid material aids the user in placing and activating the device. In this way, a device located in a cavity defined by opposing wall members will not be forced through a wall member upon application of blunt force.

The body may comprise a first end and an opposed second end. Preferably, the body comprises a bore extending at least partially along the length of the body. In some embodiments of the invention, the bore may extend all the way through the body from the first end to the opposed second end. Thus, it is envisaged that the bore may comprise a pair of open ends, or one open end and one closed end. The bore may be substantially linear, or may have a curved or tortuous path. The bore may be of any suitable length and any suitable diameter. The diameter of the bore may be substantially constant along its length, or may vary along its length. For instance, the bore may taper along at least a portion of its length, may include a neck or similar narrowing portion and the like.

As previously stated, the plurality of arm members may be mounted relative to the body. In an embodiment of the invention, a plurality of arm members may be connected to the body. Preferably, the plurality of arm members may be located on an external surface of the body. More preferably, the plurality of arm members may be located on an external surface of the body towards the first end of the body or located at the first end of the body. In some embodiments of the invention, the plurality of arm members may be connected to the body via a connection member located on the body. Any suitable type of connection member may be provided to the body. However, it will be understood that the type of connection member may vary depending on a number of factors including the type and degree of movement required of the arm members, the strength and load requirements of the arm members and webbing and type of material the arm members and body of the device are fabricated from. In this instance, it will be understood that the arm members may comprise a complementary connection member configured to connect to the connection member located on the body. The connection member may include a connection portion configured to a complementary connection portion on the arm members. The connection portions may comprise, for instance, screw-threaded portions, portions adapted for frictional engagement with one another, clips, clamps, clasps or the like, or any suitable combination thereof.

In a preferred embodiment, the arm members may be mounted so that they may move relative to the body. For instance, the plurality of arm members may be mounted so as to be foldable, hingedly or slidably movable relative to the body. Most preferably, the plurality of arm members may be pivotally mounted relative to the body. Alternatively, the plurality of arm members may be connected to the body and configured to flex or bend at a point in proximity to the point at which the arm member connects to the body.

In an embodiment of the invention, the plurality of arm members may be spaced around at least a portion of the outer circumference of the body. More preferably, the plurality of arm members may be spaced around the entire outer circumference of the body. The arm members may be spaced at any distance from one another around the circumference of the body, although in a preferred embodiment of the invention, the arm members may be spaced evenly or equidistantly around the outer circumference of the body.

The arm members may be of any suitable size, shape, or configuration. The length of the arm members may vary, although it is envisaged that the length of the arm members may be less than the length of the body of the device such that in a retracted position, the arm members do not extend beyond the ends of the body of the device. Preferably, the length of the arm members may be substantially identical to the length of the body. However, the shape and configuration of the arm members may vary depending on the type of wall system. For instance, for an interior wall system, relatively narrow arm members may be suitable. Alternatively, for an exterior wall system, the arm members may be relatively wide.

Each of the plurality of arm members may be of the same length. Alternatively, at least one arm member may be of a different length to the other arm members. The arm members may be of any suitable configuration, for instance, the arm members may comprise an elongate structure, two or more elongate structures positioned at any suitable orientation to one another (e.g. parallel), two or more elongate structures forming a shape therebetween, or the like. Preferably however, the configuration of the arm members increases stability and disperses weight or stress across the webbing member.

In an embodiment of the invention, each of the arm members may be a unitary structure. In a further embodiment of the invention, at least a portion of the arm members may comprise two or more arm member portions connected to one another. In a further embodiment of the invention, the arm members may comprise two or more arm member portions wherein each of the arm member portions are pivotally connected. Preferably, the arm members are elongate members. In this embodiment of the invention, it is envisaged that the arm members may be substantially linear. In embodiments of the invention in which the arm members comprise two or more arm member portions, it is envisaged that each arm member portion may be substantially linear. The arm member portions may be disposed at any suitable angle to each other in the retracted condition, although it is envisaged that, in the extended condition, the arm member portions may be aligned such that the arm member is substantially linear.

In an embodiment of the invention, each of the arm members may comprise one or more first arm member portions pivotally mounted to a first end of the body and a second arm member portion pivotally mounted to the one or more first arm member portions at a first end thereof and to a portion of the body at a second end thereof. Thus, it is envisaged in use, that the one or more first arm member portions may be moved relative to the second arm member portion to move the arm members from a retracted condition to an extended condition. In some embodiments of the invention, the second arm member portion may act as a brace to lock the first arm member portions in place. Thus, in this embodiment of the invention, the second arm member portion may be oriented at an angle to the first arm member portion. It is envisaged that the second arm member portion may be mounted to the first arm member portion at a point between opposed ends of the first arm member portion. It is envisaged that the first arm member portion and the second arm member portion may be mounted to the body at points spaced apart from one another by at least a portion of the length of the body.

The arm members may be fabricated from any suitable material. For instance, the arm members may be fabricated from ferrous metals (such as mild steel, carbon steel), non-ferrous metals and alloys (such as aluminium, brass, or the like), polymeric materials, or plastic, and in particular, a relatively durable plastic such as polycarbonate, polyethylene, polypropylene, polystyrene, polyvinyl chloride, acrylonitrile butadiene styrene and the like, or any suitable combination thereof. In an embodiment of the invention, at least a portion of the arm members may be fabricated from a flexible material. In this instance, it will be understood that the arm member may flex or bend at the point where the flexible material may be located. In some embodiments of the invention, each of the arm members of the plurality of arm members may be fabricated from the same type of material, or from different types of materials. In some embodiments of the invention, the arm members may be fabricated from the same type of material as the body, or from different types of materials. It will be understood, however, that excessive flex in the arm members may be undesirable, as this may lead to cracking or breaking of plaster applied to the webbing material.

It is envisaged that, in the extended condition, at least a portion of the arm members may be brought into abutment with an inner surface of a wall member (i.e. a surface of the wall member within the cavity). In an embodiment of the invention, the arm members may be retained in connection with the inner surface of the wall member by frictional engagement. For instance, the arm members may be retained in connection with the inner surface of the wall member by the natural adhesion of the webbing member to the surface. For instance, the arm members may be retained in connection with the inner surface of the wall member by providing an opposing force on the opposing wall member. Alternatively, the arm members may be adapted to adhere to the inner surface of the wall member so as to retain the device in place in readiness for the application of the filler material. For instance, the arm members may be provided with one or more adhesive patches thereon adapted to adhere the arm members to the inner surface of the wall member, an adhesive may be applied by a user on at least a portion of the arm members, or the like. It is envisaged that at least a distal region of the arm members furthest from the body may be placed in abutment with the inner surface of the wall member. In this embodiment, a proximal region of the arm members closest to the body may be located within the hole or opening in the wall member and therefore may not be located in abutment with the inner surface of the wall member.

In an embodiment of the invention, a webbing member extends between two or more of the arm members. In a preferred embodiment, the webbing member extends between each of the plurality of arm members. In an embodiment, one webbing member may be used. In a further embodiment, a plurality of webbing members may be used. In a preferred embodiment of the invention, the webbing member may comprise a cover disposed over the exterior of the device, wherein the cover may be configured to be expandable. The webbing member may be of any suitable size, shape, or configuration. The radius of the webbing member may vary, although it is envisaged that the radius may be less than the length of the arm members. In a preferred embodiment, the radius of the webbing member is substantially identical to the length of the arm members.

The webbing member may be fabricated from non-ferrous metals and alloys (such as aluminium), galvanised steel, fibreglass, natural or synthetic fibrous material, leather or plastic. In a preferred embodiment of the invention, the webbing member may be fabricated from a plastic or a polymeric material. Any suitable polymeric material may be used. Preferably, however, the polymeric material may be a stretchable or may be used to manufacture a webbing member which is stretchable. For instance, the elastomeric material may comprise polyethylene, polyethylene terephthalate, polypropylene, polyolefin, polyesters, polystyrene, polybutadiene, polyurethane, polyfluropolymers, nylon, elastomers, neoprene, silicone, silanes, natural rubber, butyl rubber, nitrile rubber, or any suitable combination thereof.

The webbing member may be a continuous member or may be provided with one or more apertures therethrough, such as in the form of a mesh material. In some embodiments of the invention, the surface of the webbing member may be textured or roughened. In this way, the adherence of the filler material to the webbing member may be enhanced. In a preferred embodiment of the invention, the webbing member may be fabricated from a flexible material, such as a flexible sheet or film material. Preferably, the webbing member may be configured to be expandable. For instance, the webbing member may be fabricated from a stretchable material, may comprise one or more folded portions or pleats, may be fabricated from a mesh wherein the size, shape, or configuration of the apertures enables the webbing member to expand, or any suitable combination thereof.

In an embodiment of the invention, the webbing member may be attached to the plurality of arm members. The webbing may be formed integrally with the arm members or may be formed separately to the arm members and configured for fixed or removable attachment thereto. For instance, the webbing member may be attached to the arm members using an adhesive. In other embodiments of the invention, the webbing member may be adhered to the arm members using any suitable technique, such as a heat treatment or chemical treatment technique. Alternatively, the webbing member may be retained on the arm members using one or more mechanical fasteners (screws, bolts, nails, rivets, pins or the like) or may be adapted to connect to the arm members using any suitable attachment portion (such as a snap fitting, hook and loop connector, ties, clamps, clasps or the like). In an embodiment of the invention, the arm members may be provided with an attachment portion configured to attach each arm member to the webbing member. In a preferred embodiment of the invention, the attachment portion may be located in an end region of the arm member and configured to attach the arm member to at least a portion of the webbing member at or near the perimeter of the webbing member.

In an embodiment of the invention, the webbing member may be attached to each arm member on at least a portion of the arm member. In a further embodiment, the webbing member may be attached to each arm member along substantially the entire length of the arm member. In another embodiment of the invention, the webbing member may be attached to at least a portion of the body of the device.

It is envisaged that, in the extended condition, at least a portion of the webbing member may be brought into abutment with an inner surface of a wall member (i.e. a surface of the wall member within the cavity). In an embodiment of the invention, the webbing member may be retained in connection with the inner surface of the wall member by frictional engagement. For instance, the webbing member may be retained in connection with the inner surface of the wall member by the natural adhesion of the webbing member to the surface. For instance, the webbing member may be retained in connection with the inner surface of the wall member by providing an opposing force on the opposing wall member. Alternatively, the webbing member may be adapted to adhere to the inner surface of the wall member so as to retain the device in place in readiness for the application of the filler material. For instance, webbing member may be provided with one or more adhesive patches thereon adapted to adhere the webbing member to the inner surface of the wall member or an adhesive may be applied by a user on at least a portion of the webbing members.

In a retracted condition, the arm members may be positioned substantially parallel to the longitudinal axis of the body of the device and the webbing member extending between each of the plurality of arm members may be at least partially folded against the body of the device. The arm members may be naturally biased into the retracted condition (for instance by one or more biasing members, such as one or more springs or the like). Alternatively, the arm members may be associated with one or more biasing members (such as one or more springs or the like) that naturally bias the arm members into the extended condition. In this embodiment of the invention, the one or more arm members may be retained in the retracted condition against the natural bias of the biasing members via one or more retention members.

The retention members may be of any suitable form. For instance, the retention members may comprise one or more bands, collars or similar members adapted to retain the arm members in the retracted condition (for example by being placed about the circumference of the body). It is envisaged that, in this embodiment of the invention, displacement of a displaceable member may urge the retention member out of engagement with the arm members and as a result, the arm members may move from the retracted condition to the extended condition under the natural bias of the biasing members. Alternatively, the retention members may include receiving portions (such as channels, recesses or the like) adapted to at least partially receive and retain the arm members therein (for instance, via snap fittings, frictional fittings, interconnecting male and female members etc.). In other embodiments of the invention, one or more locking members (pins, levers or the like) may be provided (with or without the use of receiving portions) to retain the arm members in the retracted condition. It is envisaged that, in this embodiment of the invention, displacement of the displaceable member may result in the release of the locking members and movement of the arm members from the retracted condition to the extended condition.

In an extended condition, it is envisaged that the arm members may extend radially outwardly at an angle to the longitudinal axis of the body of the device and the webbing member may be stretched relatively tightly between the arm members to form a substantially planar surface. Preferably, in an extended condition, the arm members extend radially outward and substantially perpendicular to the longitudinal axis of the body of the device and the webbing member the webbing member is stretched relatively tightly between the arm members to form a substantially planar surface.

In an embodiment of the invention, the displacement of a displaceable member actuates the plurality of arm members to move relative to the body between a retracted condition and an extended condition. In an alternative embodiment of the invention, the displacement of the displaceable member actuates the plurality of arm members to move relative to the body between an extended condition and a retracted position. The arm members may move relative to the body in any suitable manner. For instance, the arm members may move relative to the body in sliding or telescoping movement. More preferably, the arm members pivot or move hingedly relative to the body between the retracted condition and the extended condition. In a preferred embodiment, the arm members may be spring biased towards movement relative to the body.

The displaceable member may be associated with the body in any suitable manner. In some embodiments the displaceable member may be located on the body. The displaceable member may be located on any suitable portion of the body. For example, the displaceable member may be located at or adjacent an end of the body, and preferably an end of the body that in use is located at or adjacent the inner surface of the damaged wall member of the wall structure. In other embodiments, the displaceable member may be at least partially located within the bore.

The displaceable member may be of any suitable form. In an embodiment of the invention, the displaceable member may be adapted to be retained at least partially within the bore of the body. In some embodiments of the invention, the displaceable member may be in the form of a spreader mechanism that acts between the bore of the body and the arm members. In an embodiment of the invention, the displaceable member may be in the form of a spring that acts between the bore of the body and one or more tensioning elements attached to the arm members. In a further embodiment of the invention, displacement of the displaceable member releases a locking member (such as a hook) securing the arm members to the exterior surface of the body. In a preferred embodiment, the displaceable member may be in the form a thrust wire located in the bore of the body and engaged with a groove located in the body and a retention member located about the circumference of the body. Preferably, actuation of the displaceable member actuates one or more retention members to move out of engagement with the arm members, thereby releasing the arm members for movement relative to the body.

In some embodiments of the invention, the displaceable member may include an actuation portion adapted for actuation by a user. Any suitable actuation portion may be provided, such as, but no limited to, a button, trigger, switch, lever, sliding member or the like. It is envisaged that a user may actuate the actuation portion which in turn causes displacement of the displaceable member so as to release the arm members.

In other embodiments of the invention, the displaceable portion may comprise a pin or similar device that must be retracted or moved to free the arm members to move between the retracted condition and the extended condition. In other embodiments, a user may be break or cut a retention member (such as tape, thread, a band etc.) in order to release the arm members for movement relative to the body.

In an embodiment of the invention, the displaceable member may comprise an actuation portion, wherein one or more guide members extend outwardly from the actuation portion such that they extend axially along at least a part of the length of the body of the device. The actuation portion may be of any suitable size, shape or configuration. Preferably however, the actuation portion may be of a sufficient size, shape or configuration to retain the one or more guide members in a configuration suitable to connect to the sleeve member and to facilitate the user in moving the displaceable member. In an embodiment of the invention, the actuation portion may be configured such that a user may insert a finger or tool under a portion of the actuation portion to pull the displaceable member out and away from the first end of body.

The one or more guide members may be of any suitable size, shape or configuration. Preferably however, the guide members are elongate structures. In an embodiment of the invention, the guide members may comprise a connection portion configured to connect the guide member to at least a portion of the sleeve member. Preferably, the guide members may be removably connectable to the sleeve member. In some embodiments of the invention, the one or more guide members may be located within the bore of the body or may be located along the exterior of the body.

In a preferred embodiment of the invention, the displaceable member may be associated with a sleeve member configured for movement relative to the body. The sleeve member may move relative to the body in any suitable manner, although in a preferred embodiment, the sleeve member may be configured for sliding movement relative to the body of the device. In this instance, it is envisaged that displacement of the displaceable member causes the sleeve member to slide along at least a portion of the length of the body. In a preferred embodiment of the invention, the sleeve member may be associated with one or more arm members, wherein movement of the sleeve member may move the arm members from a retracted condition to an extended condition. Preferably, the sleeve member may be associated with the second arm member portion of each arm member, wherein movement of the sleeve member may cause the second arm member portion to pivot relative to the body, causing the one or more first arm member portions to pivot relative to respective second arm member portions and moving the one or more first arm member portions from a retracted condition to an extended condition.

The sleeve member may be of any suitable size, shape or configuration. In a preferred embodiment of the invention, the sleeve member may be located in abutment with, or close proximity to, an outer surface of the body. In some embodiments of the invention, the sleeve member may extend partway about the circumference of the body. In other embodiments of the invention, the sleeve member may extend substantially about the circumference of the body. In this embodiment, it is envisaged that the sleeve member may comprise an annular member.

Preferably, the length of the sleeve member may be less than the length of the body. In this way, the sleeve member may move relative to the body. It is envisaged that the ends of the body may define the limits of movement of the sleeve member relative to the body. More preferably, one end of the body may define the limit of movement of the sleeve member relative to the body in a first direction, while the limit of movement of the sleeve member relative to the body in an opposed second direction may be located at a point between opposed ends of the body. In some embodiments of the invention, one or more stop members may be located on the body in order to define the limit of movement of the sleeve member.

In a preferred embodiment of the invention, the sleeve member is substantially precluded from rotational movement relative to the body. This may be achieved using any suitable technique. However, it is envisaged that, when the sleeve member is connected to the guide members, that the connection between the sleeve member and the guide members may substantially preclude the sleeve member from rotating relative to the body.

In some embodiments, it is envisaged that the guide members may be received in a channel, slot, recess, or bore (referred to collectively as a "channel" for the sake of simplicity) in the sleeve member. In this way, the sleeve member may be configured to slide relative to the guide members (and the body) between opposed ends of the body, but may be substantially precluded from rotating relative to the body.

The displaceable member may be located at any suitable location. In an embodiment of the invention, the displaceable member is at least partially located within the bore in the body. In some embodiments of the invention, a user may be required to insert a finger or tool into the bore in order to actuate the displaceable member. This arrangement may assist in reducing or eliminating the risk of the unwanted or unintentional release of the arm members for movement between the retracted condition and the extended condition. Alternatively, the displaceable member (or, at least, the actuation portion of the displaceable member) may be located on the exterior of the body, such as at an end of the bore.

In an embodiment of the invention, the arm members may be locked in an extended condition. In this embodiment of the invention, it is envisaged that the arm members may be substantially precluded from returning to the retracted condition, or even from moving out of the extended condition. This may be achieved using any suitable technique. For instance, once or more stop members may be provided that substantially preclude movement of the arm members. Alternatively, movement of the arm members from the retracted condition to the extended condition may remove the arm member from the receiving portions. For instance, the arm members may be moved out of alignment with the receiving portions, such that the arm members cannot return to the receiving portions and the retracted condition. In an alternative embodiment, a locking collar located towards the first end of the device and having a plurality of recessed portions adapted to at least partially receive the arm members is provided. In an unlocked condition, each extended arm member is substantially aligned with a recessed portion in the locking collar and movable therein. When the locking collar is moved relative to the body (for instance, by being rotated relative to the body and, in a specific embodiment, rotated approximately 45 degrees to the body), the extended arm members and the recessed portions may no longer be aligned. In addition, the locking collar may substantially preclude the movement of each extended arm member, relative to the body and/or into the retracted condition, Preferably, the device may comprise an adjustment member. The adjustment member may be of any suitable size, shape or configuration. The adjustment member may comprise a first end and an opposed second end. Preferably, the adjustment member may be adapted to be at least partially received in the bore of the body and be retained therein. Preferably, the adjustment member may engage with the bore of the body. In some embodiments of the invention, a portion of the adjustment member may be received and retained in the bore of the body, while in other embodiments of the invention, substantially all of the adjustment member may be received and retained in the bore of the body. In a preferred embodiment, the adjustment member is partially received in the bore of the body and engaged therewith.

Preferably, the adjustment member may be configured to be at least partially received within the bore of the body at a first end of the adjustment member. Preferably, the adjustment member comprises a base portion located at an opposed second end thereof. The base portion may be of any suitable size, shape or configuration. Preferably, however, the base portion may be of sufficient size, shape and configuration to stabilise the device between opposing wall members in the damaged wall structure during and after repairing a hole in a wall member.

As previously stated, the adjustment member may be configured for engagement with the bore of the body. Preferably, the adjustment member may be adjustably engaged with at least a portion of the bore of the body, such that the adjustment member is capable of movement relative to the body. In a preferred embodiment of the invention, the adjustment member may be adjustably engaged with an insert located in the bore of the body. The insert may be located in any suitable portion of the bore of the body. Preferably, however, the insert may be located towards the second end of the body (i.e. the end of the body closest to the inner surface of the undamaged wall member of the wall structure). In use, it is envisaged that the insert may be removable such that different types and sizes of adjustment members may be used or the device may be used without an adjustment member.

The adjustment member may be adapted for adjustable engagement with the body by any suitable means. For instance, the body and the adjustment member may be retained in adjustable engagement via a frictional fitting. The body and the adjustment member may slide relative to one another in order to adjust the overall length of the device. Preferably, the body and the adjustment member may be provided with complementary attachment enhancement portions that facilitate the adjustable engagement of the adjustment member to the body. Preferably, more than one type of complementary attachment enhancement portions may be provided.

The complementary attachment enhancement portions may be of any suitable form. For instance, the attachment enhancement portions may include complementary screw-threaded portions located on the body and the adjustment member. In this embodiment of the invention, it is envisaged that the body and the adjustment member may be adjustably engaged in screw-threaded attachment to one another. Thus, it is envisaged in use, that the adjustment member may be moved relative to the body to adjust the length of the device such that the ends of the body may be retained in abutment with, or close proximity to, the inner surface of opposing wall members. In a preferred embodiment of the invention, the body and the adjustment member may be rotatably or telescopically adjustable relative to one another. Alternatively, the body and the adjustment member may be adapted for ratcheting movement relative to one another.

In some embodiments of the invention, one or more stop members may be provided so as to define the limit of movement of the adjustment member relative to the body. It is envisaged that the stop member may be provided so as to prevent the adjustment member from disengaging from the body in use.

In an embodiment, an adhesive may be applied on at least a portion of the end of the adjustment member that will abut the inner surface of the opposing wall member (i.e. the undamaged or second wall member located on the opposite side of the cavity to the damaged wall member). In an embodiment of the invention, the device is retained in contact with the inner surface of the damaged wall member and the inner surface of the undamaged wall member by frictional engagement, or may be retained in place via a compressive force exerted by the device on the inner surface of opposed wall members within the wall structure.

The adjustment member may be fabricated from any suitable material. For instance, the adjustment member may be fabricated from ferrous metals (such as mild steel, carbon steel), non-ferrous metals and alloys (such as aluminium, brass, or the like), polymeric materials, or plastic, and in particular, a relatively durable plastic such as polycarbonate, polyethylene, polypropylene, polystyrene, polyvinyl chloride, acrylonitrile butadiene styrene and the like, or any suitable combination thereof. Preferably, the body and the adjustment member are fabricated from the same material.

Preferably, the device may be configured to be collapsible upon impact to the device. It will be understood that an impact to the device may include an impact to any portion of the device, such as the first end of the body, the webbing material, the plurality of arm members, the displaceable member, the second end of the body, the adjustment member or any suitable combination thereof. It is envisaged that providing a device which may be collapsible upon impact may reduce the likelihood of damage to the undamaged wall member.

In an embodiment of the invention, at least a portion of the adjustment member may be configured to be collapsible upon impact to the device. For instance, the adjustment member may be fabricated from a frangible material, may comprise one or more frangible portions, may be fabricated from a deformable, crushable, compressible or collapsible material or the like.

In a preferred embodiment of the invention, an insert located in the bore of the body adjustably engaged with the adjustment member may be configured to be collapsible upon impact to the device. In this instance, it is envisaged that the collapse or deformation of the insert may cause the adjustment member to disengage from the insert, thereby freeing the device to move relative to the adjustment member. Alternatively, where the engagement portion of the adjustment member is threaded, the insert may comprise one or more projections configured to engage with the thread of the adjustment portion, wherein upon impact, the projections deform, freeing the body to move relative to the adjustment member It will be understood that the term "collapsible" may refer to a situation in which a resiliently deformable portion of the adjustment member deforms to allow movement of the adjustment member and the body relative to one another, or where a portion of the adjustment member and/or the body is broken, damaged or undergoes plastic deformation in order to allow movement of the adjustment member and the body relative to one another.

In an alternative embodiment of the invention a biasing member, such as one or more springs, may be provided such that, upon impact to the device, the adjustment member may overcome the natural bias of the biasing member and move towards the webbing material.

In a further embodiment of the invention, the adjustment member may be retained in position relative to the body via one or more retention members. Upon impact to the device, the one or more retention members may actuate to release the adjustment member for movement relative to the body.

The device may be provided with an outer cover portion to secure the webbing member to the body of the device. Preferably, the outer cover portion may removably secure the webbing member to the body of the device. The outer cover portion may be of any suitable size, shape or configuration. For instance, the outer cover portion may be a band, a collar, a sleeve, or the like. Preferably, however, the outer cover portion may be of sufficient size, shape and configuration to removably secure the webbing member to the body of the device and protect the webbing member and/or an adhesive applied to the webbing member from damage or contact with dirt, moisture, or the like. In some embodiments of the invention, the outer cover portion may be removed prior to insertion of the device into the hole in the damaged wall member or may be removed as a result of the arm members moving into an extended condition.

In a second aspect, there is provided a method of repairing a hole in a wall structure, the method comprising:

providing a device for repairing a hole in a wall structure, the device comprising a body having a bore extending at least partially along the length of the body, a displaceable member associated with the body, and a plurality of arm members mounted relative to the body, wherein a webbing member extends between each of the plurality of arm members;

inserting the device through the hole in a damaged wall member of the wall structure;

displacing the displaceable member to actuate the plurality of arm members to move relative to the body between a retracted condition and an extended condition in which the webbing member is stretched relatively tightly between the arm members to form a substantially planar surface, and bringing the webbing member into contact with an inner surface of the damaged wall member.

Preferably, the device for repairing a hole in a wall structure of the second aspect of the invention is the device for repairing a hole in a wall structure according to the first aspect of the invention.

Preferably, the method comprises the step of adjusting the length of the device by moving an adjustment member relative to the body until a base portion of the adjustment member abuts an inner surface of the wall structure opposing the wall structure comprising the hole.

Preferably, the adjustment member of the second aspect of the invention is the adjustment member according to the first aspect of the invention. As previously stated, the adjustment member may be adapted to be received in the bore of the body and adjustably engaged thereto. In a preferred embodiment, the adjustment member may be moved relative to the body to adjust the length of the device. It is envisaged that in use, the adjustment member may be used to lengthen or shorten the device so that the webbing member may be brought into a desired position relative to the inner surface of the wall structure where the hole is located. In use, it is envisaged that the device may be retained in place via a compressive force exerted by the device on the inner surface of opposed wall members within the wall structure.

In an embodiment of the invention, the method further comprises the step of providing an adhesive on at least a portion of the webbing member. An adhesive may be provided on at least a portion of the webbing member using any suitable technique. As previously stated, the webbing member may be self-adhesive, or alternatively an adhesive may be applied on at least a portion of the webbing member. Any suitable adhesive may be used.

The device may be inserted into the hole in the wall structure using any suitable technique. Preferably, however, the device may be inserted into the wall structure by hand. In some embodiments of the invention, part of the wall structure surrounding the hole may be removed to allow the device to be inserted into the hole.

The device may be inserted into the hole in the wall structure in any suitable location. In an embodiment of the invention, the device may be inserted into the hole in the wall structure such that it is substantially aligned with the opening of the hole. In a further embodiment of the invention, two or more devices may be inserted into the hole in the wall structure. Thus, it is envisaged that two or more devices may be used to repair a larger hole in the wall structure. The two or more devices may be placed in any suitable configuration. For instance, the two or more devices may be positioned such that the webbing member of each device at least partially overlaps with the webbing member of one or more adjacent devices. In an alternative embodiment, the portions of webbing members on adjacent devices which overlap may be removed such that the remaining webbing members form a substantially planar surface. Alternatively, the two or more devices may be positioned such that the webbing member of each device does not contact the webbing member of adjacent devices. In this instance, it is envisaged that a substantially planar material, such as a piece of plasterboard, a sheet material, a patch, a material used to form a webbing member, or the like, may be attached to adjacent devices, such that the surface area of the webbing members may be effectively extended.

In some embodiments of the invention, it may be necessary to prepare the wall structure before inserting the device into the hole in the wall structure. Any suitable technique may be used to prepare the hole and surrounding wall structure, including scraping, cutting or sanding the edges of the hole to remove excess plaster or dust, cutting and removing a portion of the plasterboard surrounding the hole to enlarge the hole, cleaning the wall surface with water or suitable solvent, and or sanding the wall surface surrounding the hole. In this way, the wall surface is primed for application of the adhesive, poly or spackle filler.

As previously stated, the device is of sufficient size and shape to fit within the wall structure and within the cavity defined by opposing wall members. In an embodiment, the device is inserted into the hole such that first end of the device may be in abutment with, or close proximity to, the inner surface of the wall member where the hole is located.

When the device is positioned in a desired location, the displaceable member may be displaced to actuate the plurality of arm members to pivot relative to the body between a retracted condition and an extended condition. In the extended condition the webbing member is stretched relatively tightly between the arm members to form a substantially planar surface. It is envisaged that in use, the webbing member may be brought into direct contact with the inner surface of the wall structure where the hole is located such that the webbing member abuts the damaged wall member. In a preferred embodiment, the arm members may be locked in an extended condition before contacting the webbing member with the inner surface of the wall structure. In this embodiment of the invention, it is envisaged that the device may be used with a wall structure which may not comprise opposing wall members, or a wall structure wherein the depth of the wall cavity is greater than the maximum length of the device. In this instance, it is envisaged that an adhesive may be provided on at least a portion of the webbing member.

In an embodiment of the invention, the device is inserted into the hole such that the first end of the device may be in abutment with, or close proximity to, the inner surface of the wall member where the hole is located and the second end of the device may be in abutment with, or close proximity to, the inner surface of the opposing, undamaged, wall member. When the device is positioned between the opposing wall members, the displaceable member may be displaced to actuate the plurality of arm members. The adjustment member may be adjusted to adjust the length of the device, such that when the device is positioned between the opposing wall members, the webbing member abuts the inner surface of the damaged wall member and the base of the adjustment member abuts the inner surface of the opposing, undamaged wall member. The adjustment member may be adjusted at any suitable time. In some embodiments of the invention, the adjustment member may be adjusted to increase or decrease the length of the device before the device is inserted through the hole in the wall structure, or after the device is inserted through the hole in the wall structure. In some embodiments of the invention, the adjustment member may be adjusted after the device is positioned against an inner surface of the damaged wall member, or after the device is positioned against an inner surface of the undamaged wall member.

Optionally, an adhesive may be applied on at least a portion of the end of the device that may abut the inner surface of the opposing, undamaged, wall member. For instance, an adhesive may be applied to a base portion of an adjustment member where present, or to the second end of the body of the device. In a further embodiment, the end of the device is self-adhesive. It is envisaged that in use, the device will be brought into direct contact with the inner surface of the opposing, undamaged, wall member to adhere the device to the wall member.

In an embodiment of the invention, a poly or spackle filler may be applied directly to the webbing member after it has been located within the wall structure. In a further embodiment of the invention, a piece of plasterboard sized to substantially fit into the hole in the wall structure may be adhered to the webbing member and a poly or spackle filler may be applied to the piece of plasterboard and surrounding wall surface.

In an embodiment of the invention, the device may be used to repair a hole in an external wall. In an embodiment of the invention, the device may be used to repair a hole in a cement block in an external wall.

The present invention provides numerous advantages over the prior art. For instance, the present invention enables a user to repair a hole in a wall structure where the inner surface of the damaged wall member is not easily accessible. The present invention enables a user to repair a hole in a wall structure and reduces the risk of the patch and filler falling off the repaired surface and into the wall cavity. In addition, the present invention enables a user to more easily repair a hole in a wall surface so that the repaired surface is flush with the surrounding wall surface. The present invention is also adjustable in length, enabling a user to use the device to repair holes in wall cavities of differing depths without the need for packers, or the like. In addition, as the present invention is configured to be collapsible, it is unlikely to cause damage to the undamaged wall member if a subsequent strike occurs to the repaired surface.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF EMBODIMENTS

Figure 1A:
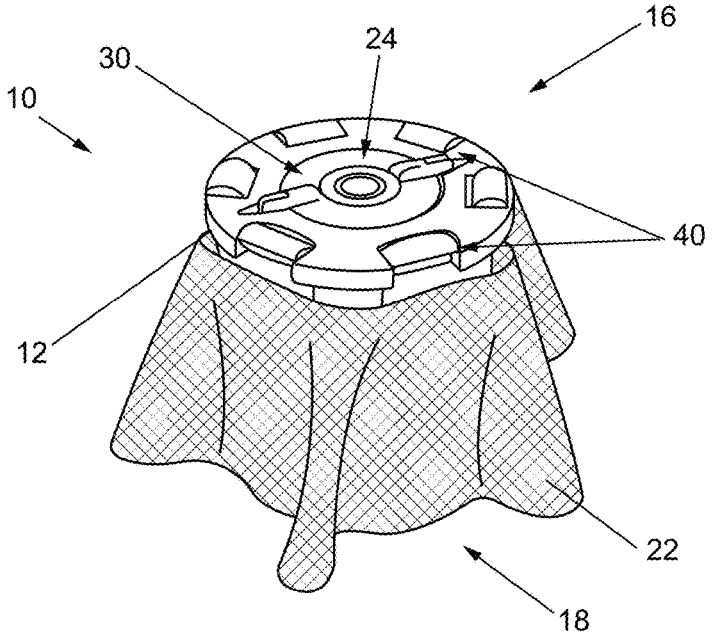
FIGS. 1*a* and 1*b* illustrate a side view of the device with arm members in a retracted condition according to an embodiment of the invention.
Figure 1B:
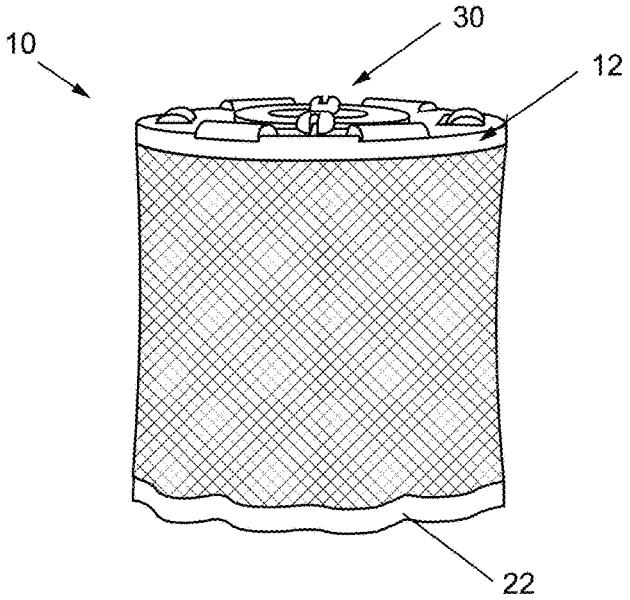

In FIGS. 1*a* and 1*b*, a side view of the device 10 with arm members 40 in a retracted condition according to an embodiment of the invention is illustrated. The body 12 comprises a bore (obscured) extending at least partially along the length of the body 12, a first end 16 and an opposed second end 18. An adjustment member 24 is received in the bore (obscured) of the body 12 and adjustably engaged thereto.

A plurality of arm members 40 are pivotally mounted at the first end 16 of the body 12. A webbing member 22 extends between the arm members 40. It is envisaged that, in use, a displaceable member 30 located at a first end 16 of body 12 is displaced, actuating the plurality of arm members 40 to pivot relative to the body 12 between a retracted condition and an extended condition.

In FIG. 1*a*, webbing member 22 comprises one or more folded portion or pleats, wherein when the plurality of arm members (not shown) are in an extended condition, the folded portions of the webbing member unfold and form a substantially planar surface. The one or more folded portions may be located between adjacent arm members (not shown). In FIG. 1*b*, webbing member 22 comprises an expandable cover disposed over the exterior of the device 10, wherein webbing member 22 may be fabricated from a stretchable material and/or a mesh wherein the size, shape, or configuration of the apertures in the mesh enables webbing member 22 to expand and form a substantially planar surface when the plurality of arm members (not shown) are in an extended condition.

Figure 2:
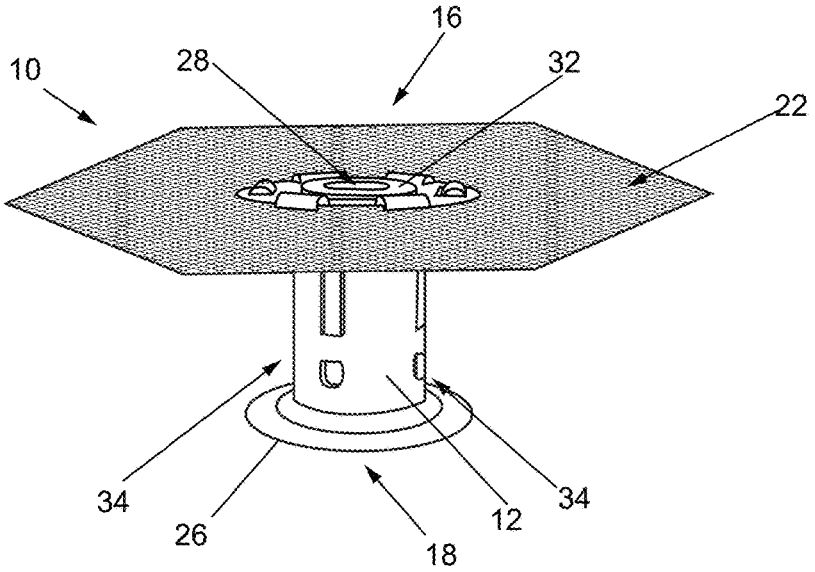
FIG. 2 illustrates a side view of the device with arm members in an extended condition and adjustment member in a retracted condition according to an embodiment of the invention.

In FIG. 2, a side view of device 10 with arm members 40 in an extended condition and adjustment member in a retracted condition according to an embodiment of the invention is illustrated. The body 12 comprises a bore (obscured), extending the length of the body 12, and a displaceable member 30 comprising an actuation portion 32 located at the first end 16 of body 12. One or more guide members 34 extend outwardly from actuation portion 32, such that guide members 34 extend axially along at least a part of the length of body 12 of device 10. Guide members 34 are shown in a disengaged condition. A plurality of arm members 40 is pivotally mounted at a first end 16 of the body 12. A webbing member 22 extends between the arm members 40. Device 10 comprises an adjustment member 24 including a threaded portion 28 screw threadedly engaged with bore 14 of device 10 and base portion 26 extending outwardly from the second end 18.

Figure 3:
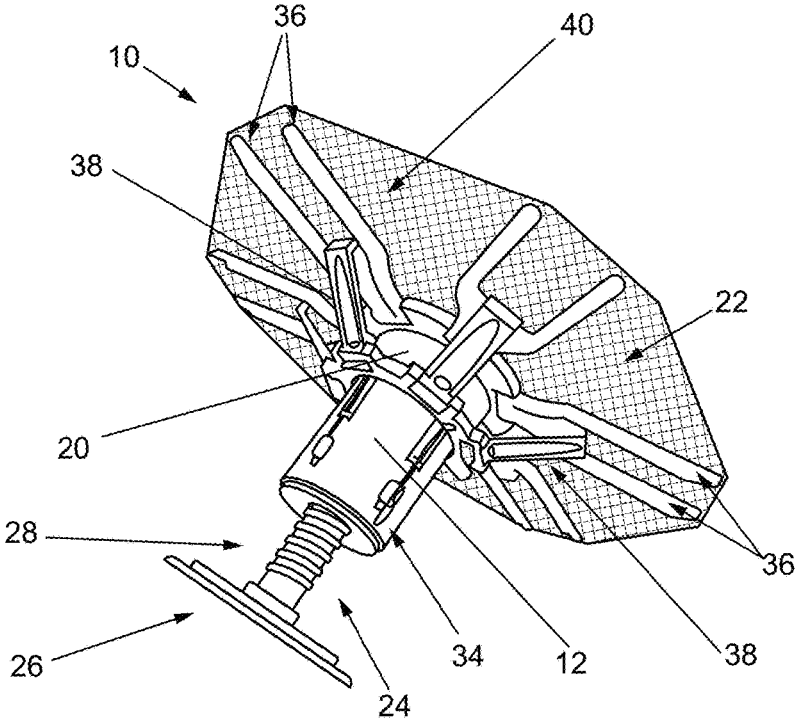
FIG. 3 illustrates a bottom perspective view of the device with arm members and adjustment member in an extended condition according to an embodiment of the invention.

In FIG. 3, a bottom perspective view of device 10 with arm members and adjustment member in an extended condition according to an embodiment of the invention is illustrated. Each arm member comprises one or more first arm member portions 36 pivotally connected to second arm member portion 38 and configured for attachment to webbing member 22. Second arm member portion 38 is pivotally connected to a sleeve member 20 which is slidably engaged with body 12. Sleeve member 20 is associated with guide members 34 of displaceable member 30 such that displacement of displaceable member 30 causes sleeve member 20 to slide along at least a portion of the length of body 12, which subsequently causes second arm member portion 38 to pivot relative to body 12. In use, it is envisaged that moving sleeve member 20 towards the first end 16 of body 12 will move arm members 40 into an extended condition and moving sleeve member 20 towards the second end 18 of body 12 will move arm members 40 into a retracted condition. In the extended condition, webbing member 22 is stretched relatively tightly between the arm members 40 to form a substantially planar surface.

In the extended condition, adjustment member 24 comprising threaded portion 28 and base portion 26 is shown extending from the second end 18 of body 12. The adjustment member 24 has been moved relative to the body 12 to lengthen the device 10.

Figure 4:
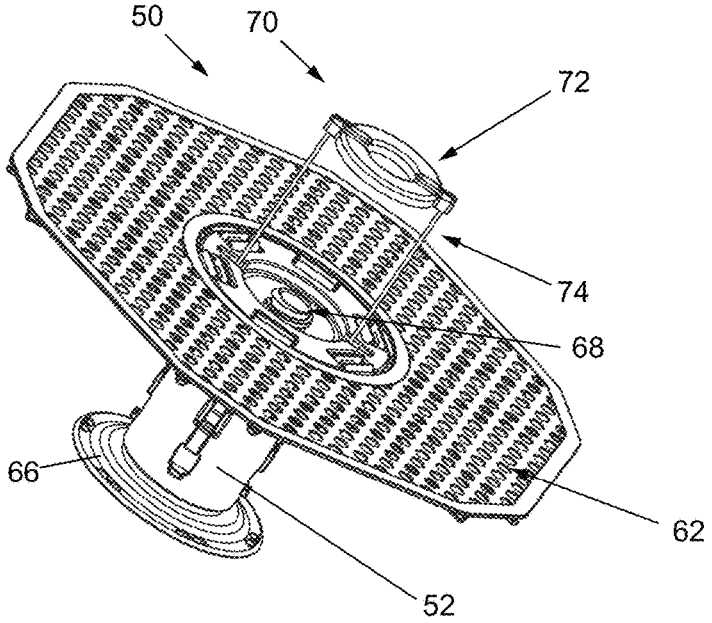
FIG. 4 illustrates a top perspective view of the device with arm members and displaceable member in an extended condition according to an embodiment of the invention.
Figure 5:
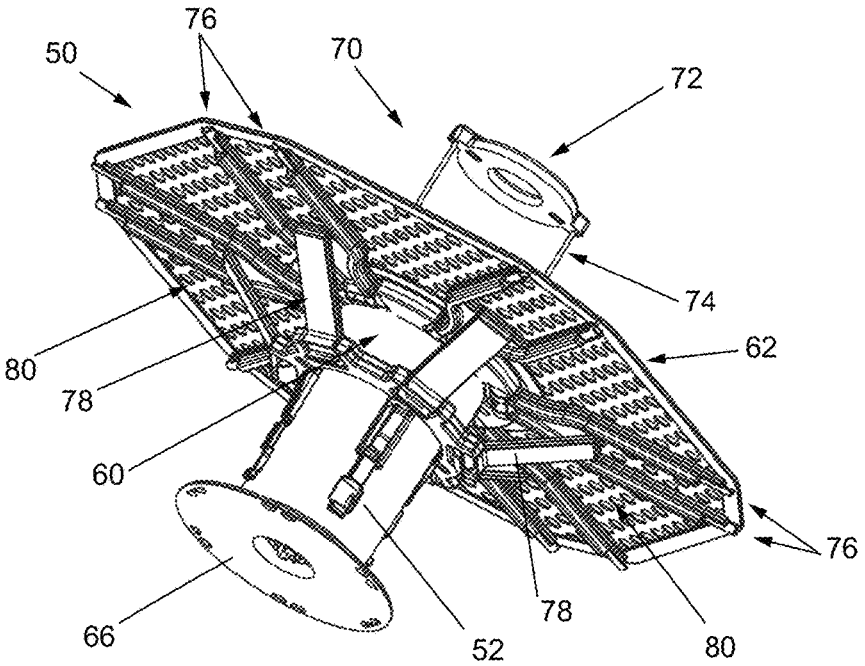
FIG. 5 illustrates a bottom perspective view of the device with arm members and displaceable member in an extended condition according to an embodiment of the invention.

In FIGS. 4 and 5, device 50 according to an embodiment of the invention is illustrated. Displaceable member 70 is displaced by pulling actuation portion 72 thereby causing the displaceable member 70 to extend outwardly from the first end 56 of body 52. Displacement of displaceable member 70 causes guide members 74 to engage with and move sleeve member 60 towards the first end 56 of body 52. Second arm member portion 78 of each arm member 80 pivots relative to body 52 and cause first arm member portions 76 to pivot relative to respective second arm member portion 78 moving first arm member portions 76 into an extended condition. Arm members 80 are shown in the extended condition, such that webbing member 62 is stretched relatively tightly between the arm members 80 to form a substantially planar surface.

Figure 6:
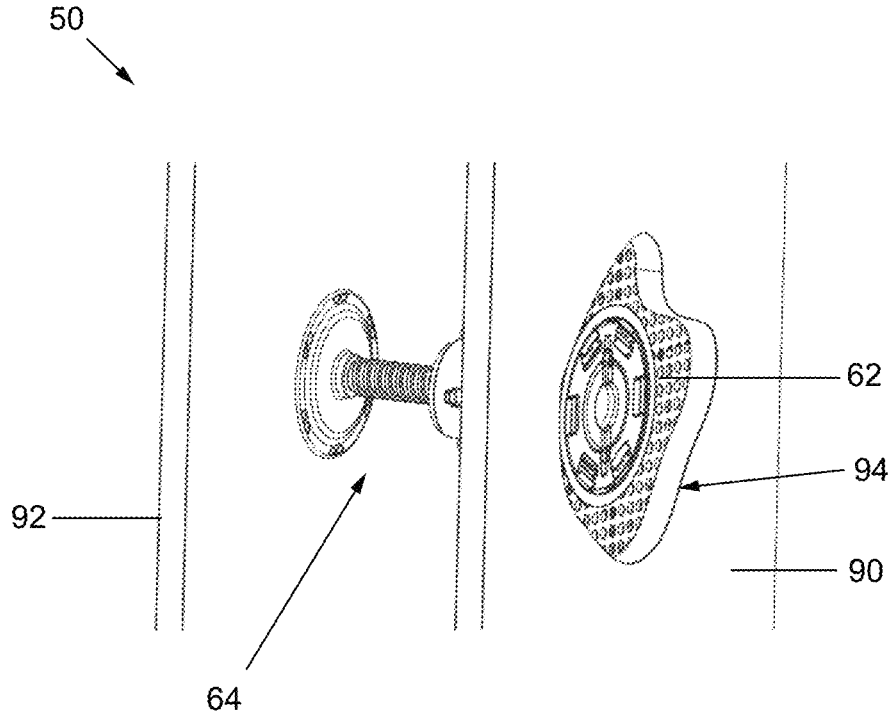
FIG. 6 illustrates a perspective view of the device with arm members and adjustment member in an extended condition in situ according to an embodiment of the invention.

In FIG. 6, a device 50 according to an embodiment of the invention is shown in an extended condition in situ. In use, a user may insert device 50 through hole 94 located in wall member 90 and pull actuation portion 72 of displaceable member 70 out and away from first end 56 of body causing guide members 74 to engage with and move sleeve member 60 along at least part of the length of body 52 towards the first end 56 of body 52. Movement of sleeve member 60 causes second arm member portion 78 of each arm member 80 to pivot relative to body 52 which in turn causes first arm member portions 76 to pivot relative to respective second arm member portion 78 placing arm members 80 into an extended condition and causing webbing member 62 to stretch relatively tightly between arm members 80. When the arm members 80 are in an extended condition, the user may use displaceable member 70 to move the webbing member 62 towards and against an inner surface of damaged wall member 90.

If necessary, the user may adjust the length of device 50 by inserting a tool, such as a screwdriver, into adjustment member 64 to engage with threaded portion 68 of adjustment member 64. Rotation of threaded portion 68 relative to bore 54 of body 52 causes adjustment member 64 to move outwardly from the second end 58 of body 52 effectively extending the length of device 50. The user adjusts the length of device 50 until base portion 66 of adjustment member 64 abuts an inner surface of the opposing, undamaged wall member 92.

When device 50 is locked in position, the user pushes actuation portion 72 of displaceable member 70 back towards the first end 56 of body 52 so that the surface of the webbing member 62 is relatively planar. The user may then apply one or more layers of filler, adhesive mesh patches, and/or paint to the hole 94 in wall member 90 to repair the hole 94.

Figure 7:
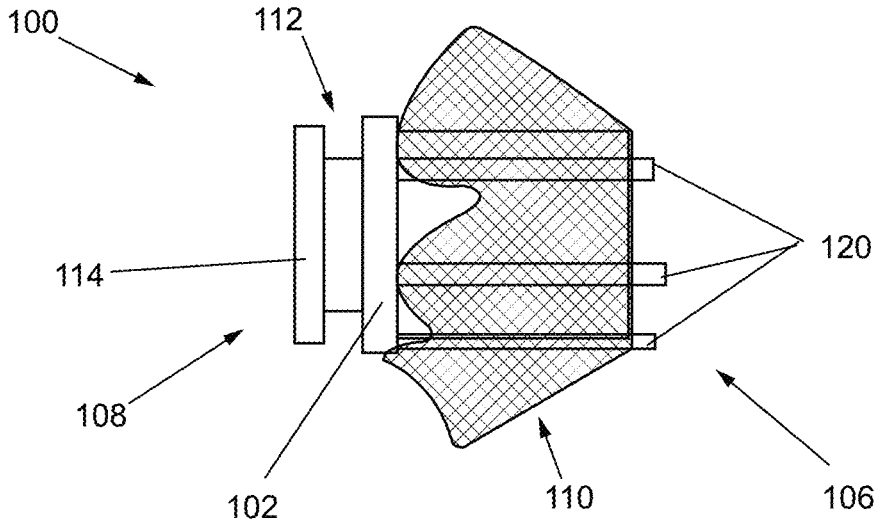
FIG. 7 illustrates a side view of the device with arm members in a retracted condition according to an embodiment of the invention.
Figure 8:
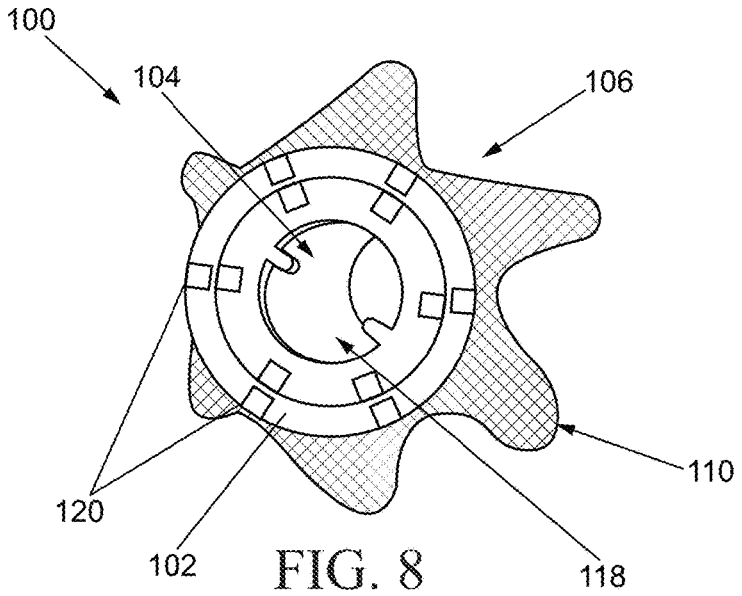
FIG. 8 illustrates an end view of the device with arm members in a retracted condition according to an embodiment of the invention.

In FIGS. 7 and 8, a device 100 with arm members 120 in a retracted condition according to an embodiment of the invention is illustrated. Body 102 comprises a bore 104 extending at least partially along the length of body 102, a first end 106 and an opposed second end 108. An adjustment member 112 is received in bore 104 of body 102 and adjustably engaged thereto in order to adjust the length of device 100.

A plurality of arm members 120 are pivotally mounted at the first end 106 of body 102. A webbing member 110 extends between the arm members 120. It is envisaged that, in use, displacement of the displaceable member 118 located in bore 104 of body 102, releases arm members 120 from body 102, thereby actuating the plurality of arm members 120 to pivot relative to body 102 between a retracted condition and an extended condition.

Figure 9:
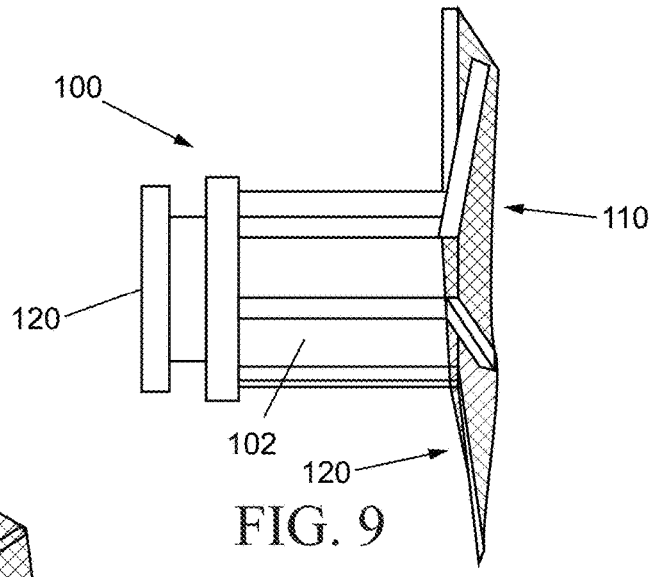
FIG. 9 illustrates a side view of the device with arm members in an extended condition according to an embodiment of the invention.
Figure 10:
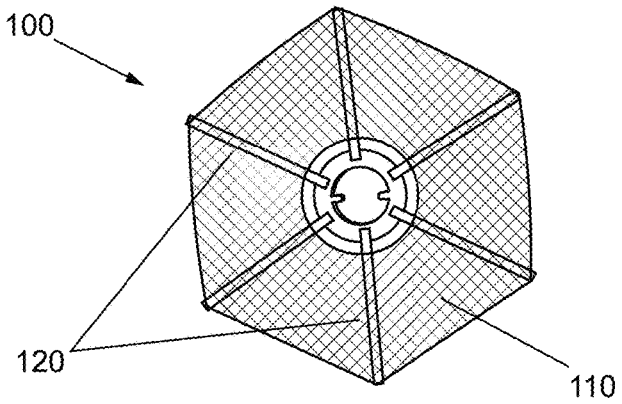
FIG. 10 illustrates an end view of the device with arm members in an extended condition according to an embodiment of the invention.

In FIGS. 9 and 10, a device 100 with arm members 120 in an extended condition according to an embodiment of the invention is illustrated. In the extended condition, webbing member 110 is stretched relatively tightly between the arm members 120 to form a substantially planar surface.

In use, a user may insert device 100 through a hole located in a wall member and depress displaceable member 118 to release arm members 120 from a locked position against the sides of body 102. Arm members 120 pivot about first end 106 of body 102 into an extended condition, causing webbing member 110 to stretch relatively tightly between arm members 120. When the arm members 120 are in an extended condition, the user pulls device 100 towards and against an inner surface of damaged wall member. If necessary, the user may rotate adjustment member 112 relative to body 102 causing adjustment member 112 to move outwardly from the second end 108 of body 102 to effectively extending the length of device 100. The user adjusts the length of device 100 until base portion 114 of adjustment member 112 abuts an inner surface of the opposing, undamaged wall member. When device 100 is locked in position, the user may then apply one or more layers of filler, adhesive mesh patches, and/or paint to the hole in the damaged wall member to repair the hole.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A device for repairing a hole in a wall structure, the device comprising:

a body;

a plurality of arm members mounted relative to the body, wherein a webbing member extends between two or more of the arm members; and a displaceable member associated with the body, and a sleeve member slidably engaged with the body, wherein displacement of the displaceable member causes the sleeve member to slide along at least a portion of a length of the body, actuating the plurality of arm members to move relative to the body between a retracted condition and an extended condition in which the webbing member is stretched relatively tightly between the arm members to form a substantially planar surface, wherein the device is configured to be collapsible upon impact to the device, and wherein the step of displacing the displaceable member involves pulling an actuating portion of the displaceable member out and away from a first end of the body causing guide members to engage with and move the sleeve member along at least part of the length of the body towards the first end of the body, and, when the device is locked in position, pushing the actuating portion of the displaceable member back towards the first end of the body so that the surface of the webbing member is maintained substantially planar.

2. A device for repairing a hole in a wall structure according to claim 1, wherein the body comprises a bore extending at least partially along the length of the body.

3. A device for repairing a hole in a wall structure according to claim 1, further comprising an adjustment member, wherein the adjustment member is adjustably engaged with the body.

4. A device for repairing a hole in a wall structure according to claim 3, wherein the adjustment member is adjustably engaged with a bore of the body.

5. A device for repairing a hole in a wall structure according to claim 3, wherein adjustment of the adjustment member moves the adjustment member relative to the body to adjust a length of the device.

6. A device for repairing a hole in a wall structure according to claim 3, wherein at least a portion of the adjustment member is configured to be collapsible upon impact to the device.

7. A device for repairing a hole in a wall structure according to claim 1, wherein each arm member of the plurality of arm members is pivotally mounted to a first end of the body.

8. A device for repairing a hole in a wall structure according to claim 1, wherein each arm member of the plurality of arm members comprises a first arm member portion pivotally mounted to a first end of the body and a second arm member portion pivotally mounted to the first arm member portion at a first end thereof and to a portion of the body at a second end thereof.

9. A device for repairing a hole in a wall structure according to claim 7, wherein movement of the sleeve member causes each arm member of the plurality of arm members to pivot relative to the body.

10. A method of repairing a hole in a wall structure, the method comprising:

providing a device for repairing a hole in a wall structure, the device comprising a body having a bore extending at least partially along a length of the body, a displaceable member associated with the body, a sleeve member slidably engaged with the body, and a plurality of arm members mounted relative to the body, wherein a webbing member extends between two or more of the arm members, wherein the device is configured to be collapsible upon impact to the device;

inserting the device through the hole in a damaged wall member of the wall structure;

displacing the displaceable member to cause the sleeve member to slide along at least a portion of the length of the body, actuating the plurality of arm members to move relative to the body between a retracted condition and an extended condition in which the webbing member is stretched relatively tightly between the arm members to form a substantially planar surface, bringing the webbing member into contact with an inner surface of the damaged wall member, and wherein the step of displacing the displaceable member involves pulling an actuating portion of the displaceable member out and away from a first end of the body causing guide members to engage with and move the sleeve member along at least part of the length of the body towards the first end of the body, and, when the device is locked in position, pushing the actuating portion of the displaceable member back towards the first end of the body so that the surface of the webbing member is maintained substantially planar.

11. The method of repairing a hole in a wall structure according to claim 10, further comprising the step of adjusting a length of the device by moving an adjustment member relative to the body until a base portion of the adjustment member abuts an inner surface of the wall member opposing the damaged wall member.

12. The method of repairing a hole in a wall structure according to 11, wherein the device is retained in place via a compressive force exerted by the device on the inner surface of opposed wall members within the wall structure.

13. The method of repairing a hole in a wall structure according to 11 further comprising the step of providing an adhesive to at least a portion of the webbing member and/or the base portion of the adjustment member.

* * * * *